US009531167B2

(12) United States Patent
Lester et al.

(10) Patent No.: US 9,531,167 B2
(45) Date of Patent: Dec. 27, 2016

(54) DEVICE AND METHOD FOR CONNECTING AN RF GENERATOR TO A COAXIAL CONDUCTOR

(71) Applicants: David P. Lester, Phoenix, AZ (US); Viswanathan Lakshminarayan, Pheonix, AZ (US); Mario M. Bokatius, Chandler, AZ (US); Basim H. Noori, Gilbert, AZ (US); Pierre Marie Jean Piel, Chandler, AZ (US)

(72) Inventors: David P. Lester, Phoenix, AZ (US); Viswanathan Lakshminarayan, Pheonix, AZ (US); Mario M. Bokatius, Chandler, AZ (US); Basim H. Noori, Gilbert, AZ (US); Pierre Marie Jean Piel, Chandler, AZ (US)

(73) Assignee: NXP USA, INC., Austin, TX (US)

( * ) Notice: Subject to any disclaimer, the term of this patent is extended or adjusted under 35 U.S.C. 154(b) by 331 days.

(21) Appl. No.: 14/293,741

(22) Filed: Jun. 2, 2014

(65) Prior Publication Data

US 2015/0349499 A1 Dec. 3, 2015

(51) Int. Cl.
*H01T 15/00* (2006.01)
*F02P 3/01* (2006.01)
(Continued)

(52) U.S. Cl.
CPC ..... *H01T 15/00* (2013.01); *F02P 3/01* (2013.01); *F02P 13/00* (2013.01); *F02P 23/04* (2013.01);
(Continued)

(58) Field of Classification Search
CPC ..... F02P 17/12; F02P 3/0884; F02P 3/01; F02P 9/002
(Continued)

(56) References Cited

U.S. PATENT DOCUMENTS 4,388,549 A 6/1983 Bensman
5,361,737 A * 11/1994 Smith ..... F02P 23/045 123/143 B
(Continued)

OTHER PUBLICATIONS

McIntyre, Dustin, L. Thesis: The Coaxial Cavity Resonator as a Prototype RF IC Engine Ignition Source West Virginia University, Department of Mechanical and Aeorspace Engineering.
(Continued)

*Primary Examiner* — John Kwon

(57) ABSTRACT

The present disclosure presents a device and method for connecting an RF generator to a coaxial conductor. The device includes a substrate, a radio frequency generator on the substrate, and a coaxial conductor coupled to a first surface of the substrate. The coaxial conductor includes a conductive core and a conductive shield around the conductive core and is configured to transmit the radio frequency signal to a radiation device. The device includes a cap coupled to the substrate and extending from a second surface of the substrate opposite the first surface. The cap includes an outer wall and a center post. The outer wall is electrically connected to the conductive shield of the coaxial conductor and the center post is electrically connected to the conductive core of the coaxial conductor. An output pad of the radio frequency generator is electrically connected to the conductive core.

20 Claims, 8 Drawing Sheets

(51) Int. Cl.

| | |
|---|---|
| ***F02P 13/00*** | (2006.01) |
| ***F02P 23/04*** | (2006.01) |
| ***H05H 1/46*** | (2006.01) |
| ***H05H 1/52*** | (2006.01) |
| *H01T 13/44* | (2006.01) |

(52) U.S. Cl.
CPC ..... *H05H 1/46* (2013.01); *H05H 1/52* (2013.01); *H01T 13/44* (2013.01); *H05H 2001/4682* (2013.01)

(58) Field of Classification Search
USPC ..... 123/594, 596, 606
See application file for complete search history.

(56) References Cited

U.S. PATENT DOCUMENTS

| | | | | |
|---|---|---|---|---|
| 6,114,811 | A * | 9/2000 | Wu | H01J 37/32192 118/723 AN |
| 7,741,761 | B2 | 6/2010 | Jaffrezic et al. | |
| 7,928,642 | B2 | 4/2011 | Malek et al. | |
| 8,547,020 | B2 | 10/2013 | Barroso et al. | |
| 8,646,129 | B1 | 2/2014 | Chen | |
| 2003/0042131 | A1* | 3/2003 | Johnson | C23C 14/3407 204/192.12 |
| 2015/0152833 | A1* | 6/2015 | Mongin | H03F 1/0288 123/623 |
| 2016/0160833 | A1* | 6/2016 | Bokatius | F02P 23/04 123/169 EL |

OTHER PUBLICATIONS

Notice of Allowance mailed Oct. 26, 2016 for U.S. Appl. No. 14/560,675 5 pages.

* cited by examiner

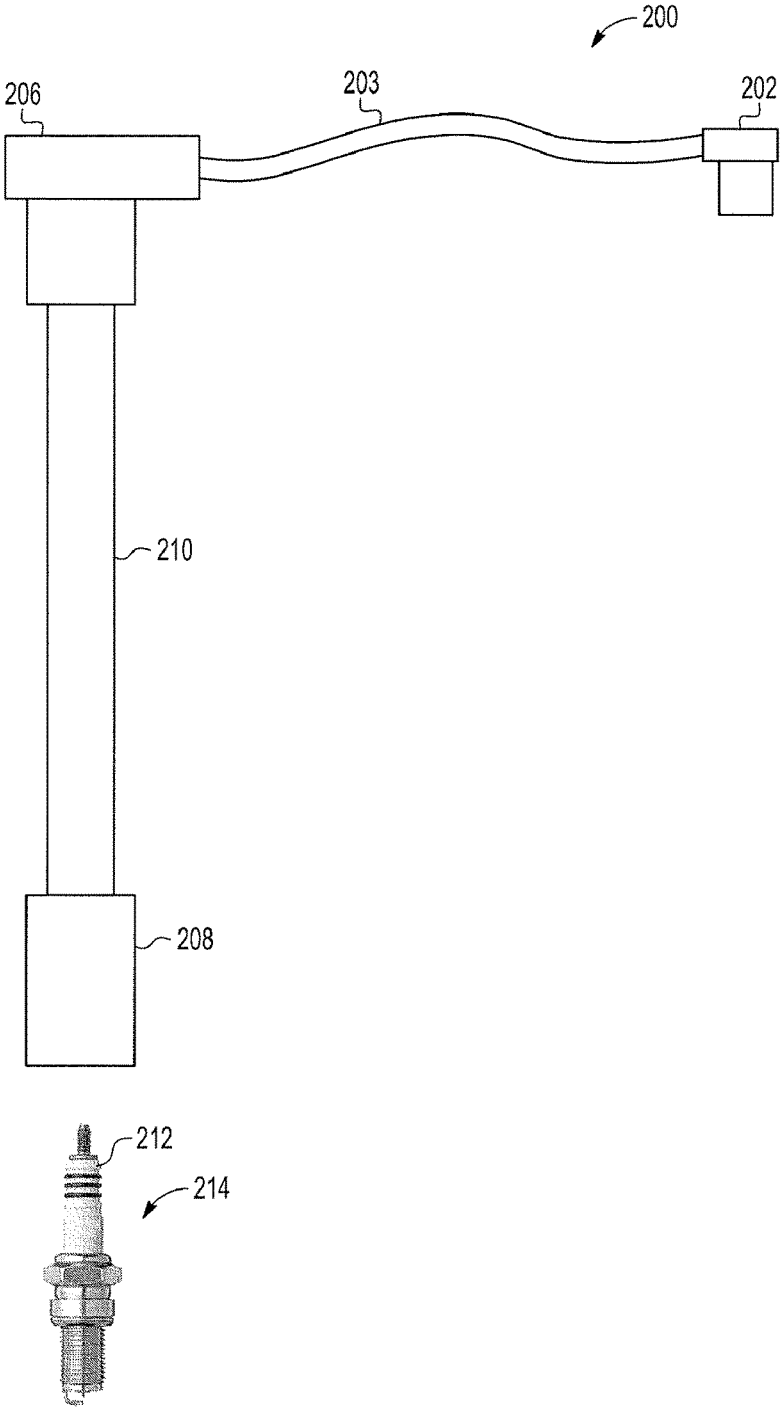
FIG. 2 -- PRIOR ART --

DEVICE AND METHOD FOR CONNECTING AN RF GENERATOR TO A COAXIAL CONDUCTOR

TECHNICAL FIELD

Embodiments of the subject matter described herein relate generally to radio frequency (RF) plasma ignition systems, and more particularly to couplings for plasma ignition systems to connect an RF power distribution system to a spark plug or other radiation device.

BACKGROUND

A typical internal combustion engine for a motor vehicle includes multiple cylinders, their associated pistons, a crankshaft, a fuel delivery and exhaust system (including a camshaft and associated valves), and an ignition system, the combination of which makes up the primary torque generation subsystem for the vehicle. When a piston is properly engaged within a cylinder, a combustion chamber is defined by the top of the piston, the cylinder sidewalls, and a cylinder head sitting atop the cylinder. During operation of the engine, the volume of the combustion chamber is varied by moving the piston linearly within the cylinder. It is the variation in the combustion chamber volume which, ultimately, may be translated into torque for propelling the vehicle.

More specifically, in both a two-stroke and a four-stroke engine, the volume of the combustion chamber is decreased and increased, respectively, during a compression stroke and a power stroke of the piston. Prior to the compression stroke (i.e., during an intake stroke), rotation of the camshaft causes a fuel intake valve to open, which allows atomized fuel to be injected into the chamber to produce a fuel/air mixture within the chamber. During the compression stroke, the piston is pushed toward the cylinder head (or toward a "top dead center" position), which compresses the fuel/air mixture, thus increasing the mixture's thermal energy. At or near the time that the piston reaches the top dead center position, a sparkplug produces a spark within the combustion chamber. The spark ignites the compressed fuel/air mixture, causing it to combust and expand. The force of expansion initiates the piston's power stroke, forcing the piston rapidly away from the cylinder head. During a subsequent exhaust stroke, the camshaft rotation causes an exhaust valve to open, thus allowing the gasses within the combustion chamber (e.g., the exhaust gasses) to exit the cylinder.

Each piston has a connecting rod coupled to the crankshaft, and during the power stroke, the connecting rod exerts a strong linear force on the crankshaft, which converts the linear force into a rotational force. In order to maintain the crankshaft rotation, the combustions within the multiple chambers are timed so that the linear forces exerted on the crankshaft by each piston are out of phase with each other. More specifically, a distributor of the ignition system is used to route high voltage from an ignition coil to each sparkplug in a carefully timed and correct firing order. The torque associated with the crankshaft's rotational force ultimately can be translated into axle and wheel rotation, thus enabling propulsion of the vehicle.

In practice, the above-described combustion process is not 100% efficient. For example, during each combustion cycle, a certain amount of unburned fuel remains in the combustion chamber after each power stroke, and the unburned fuel is exhausted to the atmosphere during the exhaust stroke. The quantity of fuel that remains unburned during a combustion cycle affects the vehicle's fuel efficiency. Thus, engine developers seek to improve ignition systems to increase the percentage of fuel within each chamber that is burned during each combustion cycle.

In addition, combustion of the fuel/air mixture results in the production of a variety of gasses, which are exhausted from the vehicle through the vehicle's exhaust system. For example, in a typical petroleum-fueled engine, exhaust gasses include nitrogen oxides ($NO_x$), carbon dioxide ($CO_2$), and carbon monoxide (CO), among other things. Some of the exhaust gasses may be harmful to humans and to the environment when they are present in sufficient quantities. Accordingly, engine developers also seek to modify fuels and ignition systems in order to reduce the quantity of potentially-harmful gasses that are exhausted into the environment.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

FIG. 2 is an illustration of a conventional integrated ignition coil/high voltage distribution component.

DETAILED DESCRIPTION

The following detailed description is merely illustrative in nature and is not intended to limit the embodiments of the subject matter or the application and uses of such embodiments. As used herein, the words "exemplary" and "example" mean "serving as an example, instance, or illustration." Any implementation described herein as exemplary or an example is not necessarily to be construed as preferred or advantageous over other implementations. Furthermore, there is no intention to be bound by any expressed or implied theory presented in the preceding technical field, background, or the following detailed description.

Embodiments of the inventive subject matter include couplings for plasma ignition systems, and associated RF power amplification and distribution systems. As will be explained in more detail below, a coupling enables the connection of an RF power amplifier and distribution system to a spark plug or other radiation device for the use of plasma energy in an ignition system. As used herein, the term "radiation device" refers to any type of device that is configured to produce a conventional spark (e.g., a spark plug) or a plasma discharge.

Similar to an ignition system of a conventional internal combustion engine, a plasma ignition system functions to combust gaseous fuel in a combustion chamber defined by a piston and cylinder arrangement. However, in a plasma ignition system, the combustion is at least partially achieved by discharging high energy plasma into the combustion chamber, rather than producing a relatively low energy spark within the combustion chamber or in combination therewith. The high energy plasma discharge can more reliably and efficiently start the process of burning fuel than a conventional spark. In addition, the plasma discharge may be produced in a combustion chamber having significantly higher pressures than would be possible for a conventional spark. Accordingly, a plasma ignition system may enable higher power operation than a conventional ignition system.

Figure 1:
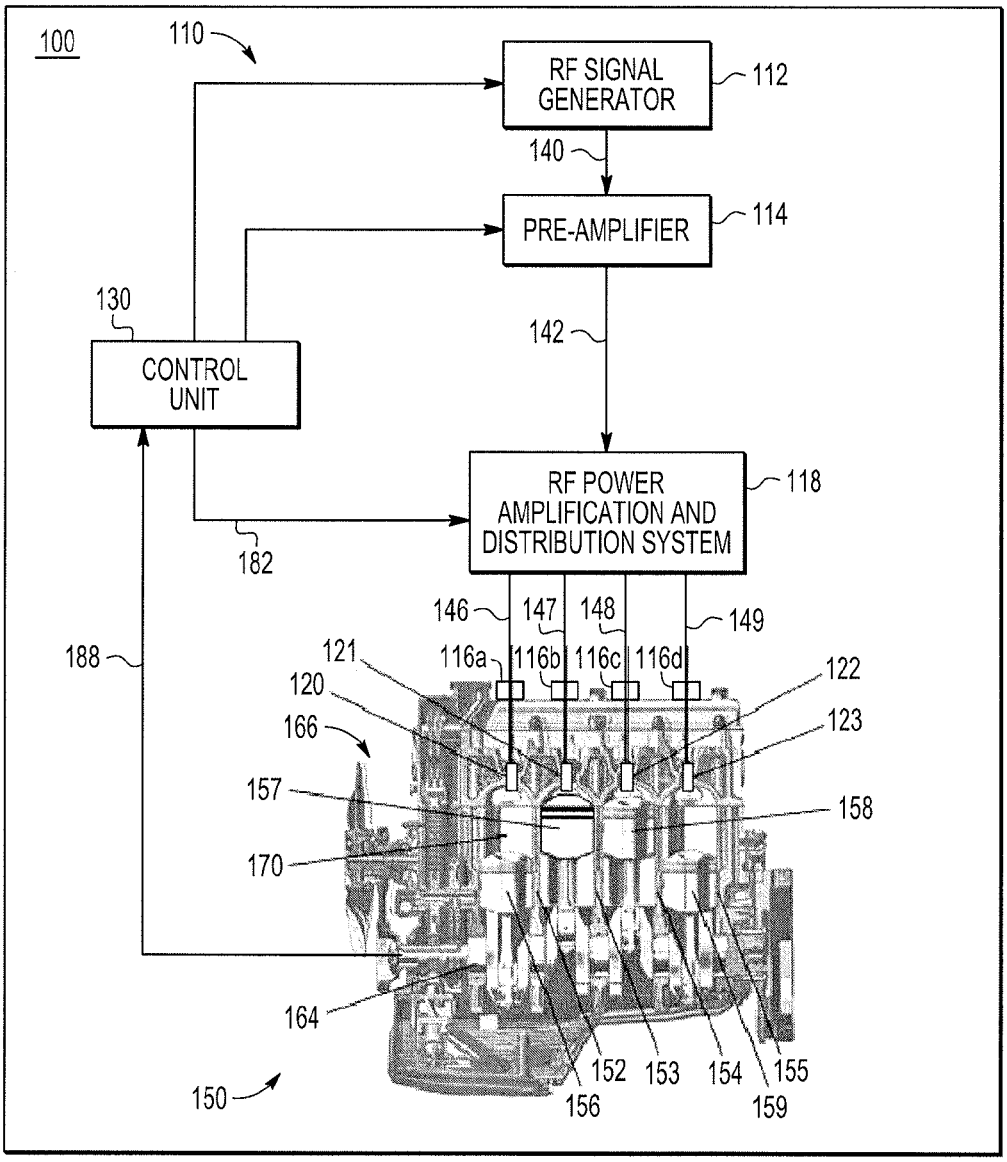
FIG. 1 is a simplified block diagram of a plasma ignition system for a four cylinder engine, in accordance with an example embodiment.

FIG. 1 is a simplified block diagram of a torque generation system 100 that includes a plasma ignition system 110 and an internal combustion engine 150, in accordance with an example embodiment. For example, the torque generation system 100 may be incorporated into a motor vehicle, and the torque generation system 100 may function as the primary source of torque used to propel the vehicle. In other embodiments, however, internal combustion engine 150 may be incorporated into a generator, machinery, or other equipment.

Internal combustion engine 150 is similar to a conventional internal combustion engine in that engine 150 includes multiple cylinders 152-155, their associated pistons 156-159 and connecting rods, a crankshaft 164, and a fuel delivery and exhaust system 166 that includes a camshaft (not numbered) configured to operate fuel intake and exhaust valves (not numbered). As with a conventional internal combustion engine, a chamber 170 is defined by each piston/cylinder pair in internal combustion engine 150, and the volume of the chamber 170 is decreased and increased, respectively, during a compression stroke and a power stroke of the piston. In contrast with a conventional internal combustion engine, however, in the internal combustion engine 150 of FIG. 1, a radiation device 120-123 of the plasma ignition system 110 produces a high energy plasma discharge in the chamber 170 at or near the time that the piston reaches the top dead center position (e.g., the position of piston 157 in cylinder 153). The plasma discharge ignites a compressed fuel/air mixture within the chamber 170, causing the fuel to combust and expand. The force of expansion initiates the piston's power stroke, forcing the piston 156-159 rapidly away from the cylinder head. The piston's connecting rod exerts a strong linear force on the crankshaft 164, which converts the linear force into a rotational force or torque. The torque associated with the crankshaft's rotational force ultimately can be translated into axle and wheel rotation, thus enabling propulsion of a vehicle within which system 100 is incorporated.

Also similar to operation of a conventional internal combustion engine, in order to maintain the rotation of crankshaft 164, the combustions within the multiple chambers 170 of internal combustion engine 150 are timed so that the linear forces exerted on the crankshaft 164 by each piston 156-159 and connecting rod are out of phase with each other (e.g., about 90 degrees out of phase with each other in a four-cylinder, four-stroke engine).

Plasma ignition system 110 is configured to provide high power RF energy to each radiation device 120-123 in order to produce a plasma discharge in each chamber 170. More specifically, plasma ignition system 110 is configured so that the high power RF energy provided to the radiation devices 120-123 is timed to achieve out of phase, timed plasma discharges within the chambers 170, and thus to cause continuous crankshaft rotation. To produce the timed plasma discharges, plasma ignition system 110 includes RF signal generator 112, pre-amplifier 114, RF power amplification and distribution system 118, and radiation devices 120-123.

RF signal generator 112 is configured to produce an RF signal 140. For example, the RF signal 140 may include periodic pulses of RF power, where each pulse is produced at or near the beginning of a power stroke for each cylinder 152-155. The duration of each pulse may be shorter than the duration of each power stroke. For example, the duration of each pulse may be from about 10 percent to about 50 percent of the duration of each power stroke, and each pulse may be timed to arrive at a cylinder at a beginning of each power stroke. The RF power in RF signal 140 may be produced at a frequency in a range of about 1.0 megahertz (MHz) to about 6.0 gigahertz (GHz) (e.g., about 2.4 GHz) according to various embodiments. In other embodiments, the frequency of the RF power may be higher or lower than the above given range. In various embodiments, there may be a single large pulse per ignition cycle or many smaller pulses per ignition cycle (e.g., 1.0 millisecond (ms) continuous pulse per ignition cycle or 500 1.0 microsecond pulses spaced 1 second apart per ignition cycle).

The output of RF signal generator 112 is coupled to the input of pre-amplifier 114. Pre-amplifier 114 may be a single stage amplifier or a multiple-stage amplifier, in various embodiments. Essentially, pre-amplifier 114 receives and amplifies the RF signal 140 produced by RF signal generator 112, in order to produce an amplified RF signal 142 having a power level that is sufficient to enable generation of a plasma discharge by radiation devices 120-123. For example, the RF signal 140 produced by RF signal generator 112 may have a power level in the milliwatt (mW) range, and pre-amplifier 114 may amplify the RF signal 140 to produce an output RF signal 142. For example, depending upon the amount of gain applied by pre-amplifier 114, pre-amplifier 114 may produce an RF signal 142 having a power level from the mW range (e.g., as low as 1.0 mW) up to a power level of hundreds or thousands of watts (W) (e.g., up to or exceeding about 2.0 kilowatts (kW)), in an embodiment. In alternate embodiments, the power levels of the RF signals 140, 142 produced by the RF signal generator 112 and/or the pre-amplifier 114 may be higher or lower than the above given ranges. In an alternate embodiment, pre-amplifier 114 may be excluded from the plasma ignition system 110.

In an embodiment that includes pre-amplifier 114, the output of pre-amplifier 114 is coupled to the input of RF power amplification and distribution system 118. Alternatively, in an embodiment that does not include pre-amplifier 114, the output of RF signal generator 112 is coupled to the input of RF power amplification and distribution system 118. Either way, RF power amplification and distribution system 118 is configured to receive an RF signal (either RF signal 140 or 142) produced by RF signal generator 112 or pre-amplifier 114, and to distribute the RF signal to the radiation devices 120-123 associated with the various piston/cylinder pairs. More specifically, RE power amplification and distribution system 118 is configured to provide multiple pulsed RF signals 146-149 to the radiation devices 120-123. According to an embodiment, the RE power amplification and distribution system 118 provides a pulsed RF signal 146-149 to each radiation device 120-123 at an appropriate time for timing the ignition process. According to a further embodiment, only one RF signal 146-149 of significant power is provided at any given time by the RF power amplification and distribution system 118 to the radiation devices 120-123.

Directional couplers 116*a*-116*d* are configured to detect the forward and reflected power of the RF signals provided to the radiation devices 120-123, and to produce signals that are transmitted to control unit 130 that indicate the detected forward and reflected power levels. According to an embodiment in which closed-loop control is implemented, control unit 130 receives the power level signals from each directional coupler 116*a*-116*d*, and based on the signals and pre-determined timing algorithms, provides control signals 182 to RF power amplification and distribution system 118. In other open-loop configurations, directional couplers 116*a*-116*d* may not be incorporated into torque generation system 100 and instead control unit 130 may receive a trigger input (e.g., via a feedback signal 188 from crankshaft 164), which indicates to control unit 130 the correct timing of the pulsed RF signals 146-149 that are to be provided by the RF power amplification and distribution system 118 to the radiation devices 120-123, and control unit 130 may provide control signals 182 to RF power amplification and distribution system 118 accordingly.

In a conventional engine, the distributor or ignition coil is connected to the engine's spark plugs using spark plug cables. FIG. 2 is an illustration of a conventional integrated ignition coil/high voltage distribution component 200. Distribution component 200 includes terminal 202 configured to couple to and make an electrical connection with a distributor or ignition coil. Terminal 202 is connected to boot 208 by wire 203. In some engine configurations, wire 203 generally includes a coaxial cable and is configured to carry the high direct current (DC) voltages supplied by the distributor or ignition coil into boot 208. In other configurations, however, wire 203 carries a relatively low voltage DC signal or control signal that is converted to a high voltage signal within head 206.

Shaft 210 includes a coaxial conductor that runs between the head 206 of shaft 210 and boot 208 along shaft 210. The coaxial conductor within shaft 210 is connected to wire 203. Boot 208 includes a connector that is configured to securely attach to terminal 212 of spark plug 214.

When installed into an engine, terminal 202 is connected to the distributor or ignition coil and boot 208 is inserted through an opening in the engine valve cover to couple boot 208 to the terminal of a corresponding spark plug. When shaft 210 is fully inserted through the valve cover and the connection has been made with the spark plug, head 206 of shaft 210 rests upon an outer surface of the valve cover. Because head 206 of shaft 210 resides outside the shell of the engine, head 206 can be exposed to lower temperatures than those experienced by boot 208. With distribution component 200 installed, the distributor or ignition coil can supply electrical energy to the connected spark plug, causing the plug to generate a spark and enabling operation of an engine.

The present disclosure provides a coupling arrangement configured to enable the delivery of RF power to a spark plug or other radiation device (e.g., radiation devices 120-123 of FIG. 1, analogous to spark plug 214 of a conventional internal combustion engine) mounted within an engine. In various embodiments, the present coupling arrangement may be implemented in a form factor similar to that of a conventional spark plug cable (e.g., distribution component 200 of FIG. 2), enabling its installation and use in a vehicle or other system designed for use with conventional distribution components.

Figure 3A:
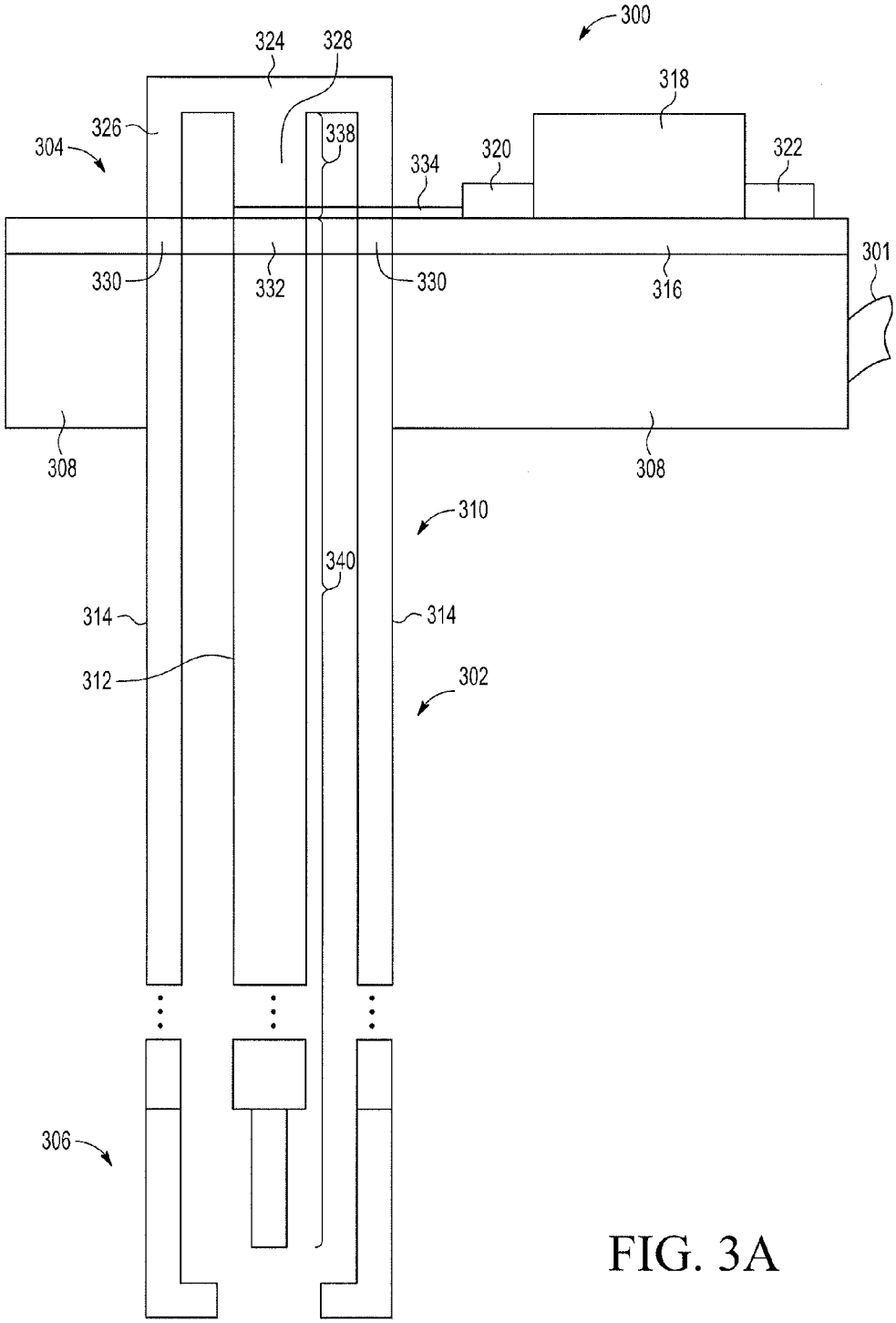
FIG. 3A is a cross-sectional view of an embodiment of a plasma ignition RF power delivery system configured to connect an RF power distribution system to a spark plug or other radiation device.
Figure 3B:
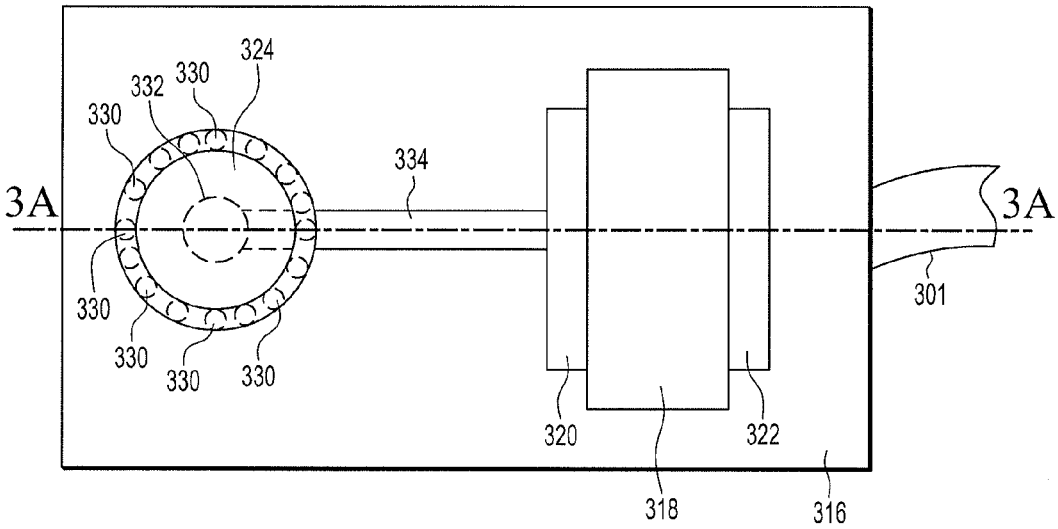
FIG. 3B shows a top view of the RF power delivery system of FIG. 3A.

FIG. 3A is a cross-sectional view of an embodiment of an RF power delivery system 300 configured to connect an RF power distribution system to a spark plug or other radiation device taken along the line 3A of FIG. 3B. FIG. 3B shows a top view of RF power delivery system 300.

System 300 includes an input cable 301. Input cable 301 may, for example, connect system 300 to one or more of RF signal generator 112, pre-amplifier 114, or control unit 130 of FIG. 1 to control the delivery of RF energy to a connected spark plug or radiation device. Input cable 301 is connected to a head 304 of sleeve 302. Sleeve 302 includes a plug boot 306 configured to securely couple to a spark plug or other radiation device. The shaft 310 of sleeve 302 includes a coaxial conductor made up of core conductor 312 and shield 314. Shield 314 may be enveloped by an insulative covering, which is not shown in FIG. 3A. The components of the coaxial conductor made up of core conductor 312 and shield 314 may have approximately circular cross-sectional shapes or, in various embodiments may have non-circular cross-sectional shapes. The core conductor 312 and shield 314 of the coaxial conductor may be formed in a suitable manner. For example, a coaxial conductor including a solid center core conductor surrounded by a dielectric material and a coaxial metallic shield, such as those found in existing spark plug cables or antennas may be utilized. In other embodiments, the core conductor 312 may instead be formed as a conductive material plated over a suitable substrate, such as a printed circuit board (PCB). The PCB with plated core conductor 312 is then disposed within a suitable conductive shield that may be formed around the PCB or on a surface of the PCB. In such an embodiment, the conductive shield may be formed as conductive sidewalls that are bolted onto or otherwise fixed to the PCB that includes the core conductor.

Figure 3C:
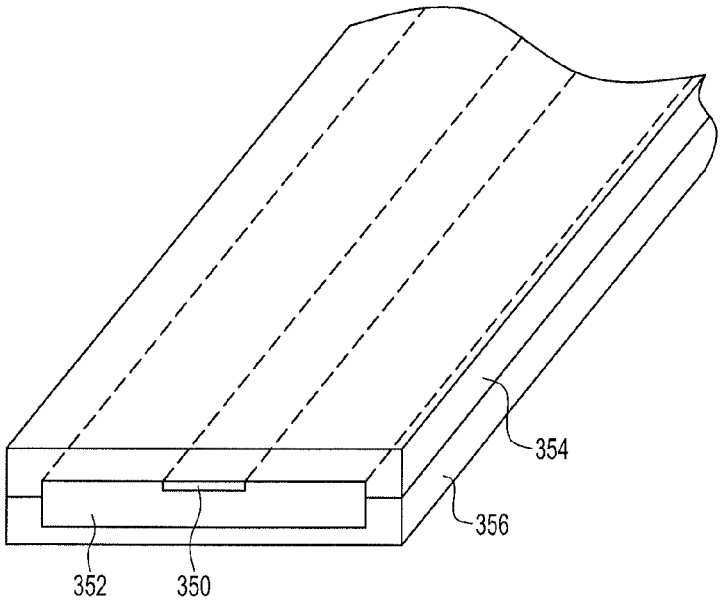
FIG. 3C shows a perspective view of an embodiment of a shaft of a sleeve depicted in FIG. 3A, including a coaxial conductor made up of a core conductor plated onto a printed circuit board (PCB).

To illustrate, FIG. 3C shows a perspective view of an embodiment of the shaft 310 of sleeve 302 including a coaxial conductor made up of a core conductor 350 plated onto a PCB 352. As shown in FIG. 3C, core conductor 350 is plated over a surface of a suitable substrate, such as PCB 352. To form the coaxial structure, a pair of conductive sidewalls 354 and 356 are fitted around PCB 352. Although two sidewalls 354 and 356 are shown in the embodiment of FIG. 3C, any number of sidewall structures may be utilized. In some embodiments, the sidewall is formed in a unitary construction having an open center allowing the sidewall to be slid over PCB 352 to provide shielding thereto.

Plug boot 306 is configured so that when, for example, plug boot 306 is coupled to a spark plug or other radiation device, core conductor 312 of sleeve 302 is connected to the terminal of the spark plug or other radiation device, while shield 314 of sleeve 302 would connect to the conductive shell of the spark plug or other radiation device, though any suitable connection to a spark plug or other radiation device may be formed.

The head 304 of sleeve 302 includes housing 308. Housing 308 generally includes a solid, supportive material upon which one or more of the components of the present coupling arrangement may be mounted. In one implementation, housing 308 includes a molded plastic structure, though any other suitable materials may be used. Housing 308 includes an opening through which at least a portion of sleeve 302 can be inserted and fixed. Sleeve 302 may be coupled to housing 308 via a friction fit, adhesive, mechanical fixtures, a threaded connection, or may simply reside in the opening formed in housing 308.

Substrate 316 is mounted to a surface of housing 308. Substrate 316 includes any structure over which one or more electrical components can be mounted and interconnected. In various embodiments, substrate 316 may include a printed circuit board (PCB), flexible PCB, or any other substrate material or combination of materials.

Cap 324 is mounted over substrate 316. Cap 324 includes a conductive material and is made up of an outer wall 326 and a center post 328, which are electrically connected to one another. Outer wall 326 and center post 328 may be fabricated as separate components that are joined together, or may be fabricated from a single piece of material. Outer wall 326 of cap 324 is electrically connected to shield 314 of sleeve 302 by conductive through hole vias (THVs) 330 formed within substrate 316. In one embodiment, THVs 330 may be formed as a number of different THVs positioned to line up with the perimeter of conductive shield 314 (see, for example, THVs 330 illustrated in FIG. 3B). Alternatively, THVs 330 may instead be formed as a single, circular THV configured to line-up with at least a portion of conductive shield 314. Center post 328 of cap 324 is electrically connected to core conductor 312 by THV 332 formed within substrate 316. Accordingly, substrate 316 is sandwiched between shaft 310 of sleeve 302 and cap 324.

RF generator 318 is mounted to a surface of substrate 316 and includes contact pads 320 and 322. RF generator 318 is configured to receive an input signal received from input cable 301 and convert that input signal into RF energy to be delivered through core conductor 312 into a connected spark plug or other radiation device.

Depending upon the type of input signal received via input cable 301 (e.g., a control signal, an RF signal, or an amplified RF signal), RF generator 318 may implement one or more of the functions provided by control unit 130, RF signal generator 112, and pre-amplifier 114 of FIG. 1. For example, if RF generator 318 receives a control signal from control unit 130, RF generator 318 may be configured to use that control signal to initiate the generation of an RF signal, amplify that RF signal, and then transmit that amplified RF signal to a spark plug or other radiation device accordingly to a timing determined by the signal received from the control unit 130. Conversely, if RF generator 318 receives a signal from signal generator 112, RF generator 318 may be configured to amplify the received signal and then deliver that amplified RF signal to a spark plug or other radiation device. Finally, if RF generator 318 receives an amplified RF signal from pre-amplifier 114, RF generator 318 may be configured to deliver that signal directly to a spark plug or other radiation device. In short, RF generator 318 may be configured to implement any one or more of the components of an RF ignition system. RF generator 318 may be implemented as a single component mounted to a surface of substrate 316 (as is shown in FIG. 3A), or as a number of different components that are each mounted to substrate 316 and interconnected to one another.

Contact pad 322 of RF generator 318 is connected to input cable 301 to receive the input signal (the connection is not shown on FIG. 3A). RF generator 318 receives the input signal, modifies it as necessary (which, if the received signal includes an amplified RF signal may not involve any modification), and then generates an output signal at output contact pad 320.

A conductive trace 334 is formed over substrate 316. Conductive trace 334 is connected to the output contact pad 320 of RF generator 318 and runs along substrate 316 to contact THV 332. In one embodiment, trace 334 is sandwiched between center post 328 of cap 324 and THV 332. As such, trace 334 connects output contact pad 320 of RF generator 318 to center post 328 of cap 324 and THV 332 and, thereby, core conductor 312 of sleeve 302. Although conductive trace 334 is shown in FIG. 3A, other methods for electrically connecting output contact pad 320 to THV 332 or center post 328 may be used, such as a wirebond, wire, and the like.

In some other embodiments, a physical connection may not be formed between the output of RF generator 318 and core conductor 312. The connection may instead be formed by induction or capacitive coupling. For example, trace 334 may be connected to a plurality of windings disposed nearby core conductor 312. As the RF signal is supplied to those windings, the windings generate an electro-magnetic field that couples with core conductor 312 inducing the RF signal therein. Alternatively, the connection may be formed by capacitive coupling. In that case, trace 334 may be connected to a conductive cylinder formed around core conductor 312 with a dielectric disposed between the conductive cylinder and core conductor 312. As the RF signal is applied to the conductive cylinder, a signal corresponding to the RF signal is induced within core conductor 312 due to capacitive coupling between the conductive cylinder and core conductor 312.

With contact pad 320 connected to THV 332 or center post 328, the output signal generated by RF generator 318 (e.g., an amplified RF signal) is transmitted into core conductor 312 of sleeve 302, where it will ultimately be transmitted into a spark plug or other radiation device coupled to plug boot 306. In this configuration, the conductive core of sleeve 302 (including core conductor 312 and shield 314) forms an odd multiple ¼ length transmission line or waveguide to communicate the RF signal outputted by RF generator 318 into the spark plug or other radiation device. In various embodiments, the conductive core of sleeve 302 can be operated as a quarter wave transmission line, where cap 324 terminates one end of the transmission line, while the other end is effectively shorted at a spark plug or other radiation device. In such an arrangement, the impedance observed at the input to core conductor 312 (i.e., the impedance observed by output contact pad 320 of RF generator 318) will be determined by the position along core conductor 312 at which the connection to output contact pad 320 of RF generator 318 is made. As the connection moves closer to the termination point of the transmission line (in this example, the point at which center post 328 of cap 324 meets outer wall 326), the impedance goes down. As such, the input impedance to core conductor 312 will be determined by the ratio of the length of center post 328 (indicated by brace 338) of cap 324 to the length of core conductor 312 plus the height of THV 332 (indicated by brace 340).

In many applications, it may be important to provide for impedance matching between the transmission line made up of cap 324, core conductor 312, and shield 314 and the output of RF generator 318. In some cases, the output impedance of RF generator 318 is somewhat fixed and difficult to adjust. In those cases, it is possible to provide for impedance matching by selecting an appropriate ratio of the length of center post 328 (indicated by brace 338) of cap 324 to the length of core conductor 312 plus the height of THV 332 (indicated by brace 340), taking into consideration the thickness of core conductor 312 and inside diameter of shield 314. In various embodiments, adjustments to any of the geometry (e.g., length, thickness, cross-sectional area and shape, overall shape and configuration, and the like), may be adjusted to provide for impedance matching or to otherwise achieve a desired input impedance observed by RF generator 318.

In addition to selecting the correct location for inputting the output signal of RF generator 318 into core conductor 312, in some embodiments, RF generator 318 may also include circuitry that enables RF generator 318 to fine tune its own output impedance to match that observed at the input to core conductor 312.

In some embodiments of RF power delivery system 300, RF generator 318 is formed within a package that itself provides all or a portion of substrate 316 and housing 308. For example, RF generator 318 may be formed with a single package that incorporates the structure of housing 308 and also provides for THVs 330 and 332.

In some embodiments, in addition to the RF energy being fed into core conductor 312, a DC voltage may also be applied to core conductor 312. The application of a separate DC voltage may, in some cases, cause a conventional spark to appear on the connected spark plug or radiation device that can be used to facilitate plasma generation. Additionally, should any of the RF generation components fail, the application of a DC voltage to core conductor 312 may operate as a back-up to provide a conventional spark enabling engine operation even though the plasma ignition system has failed.

Figure 4:
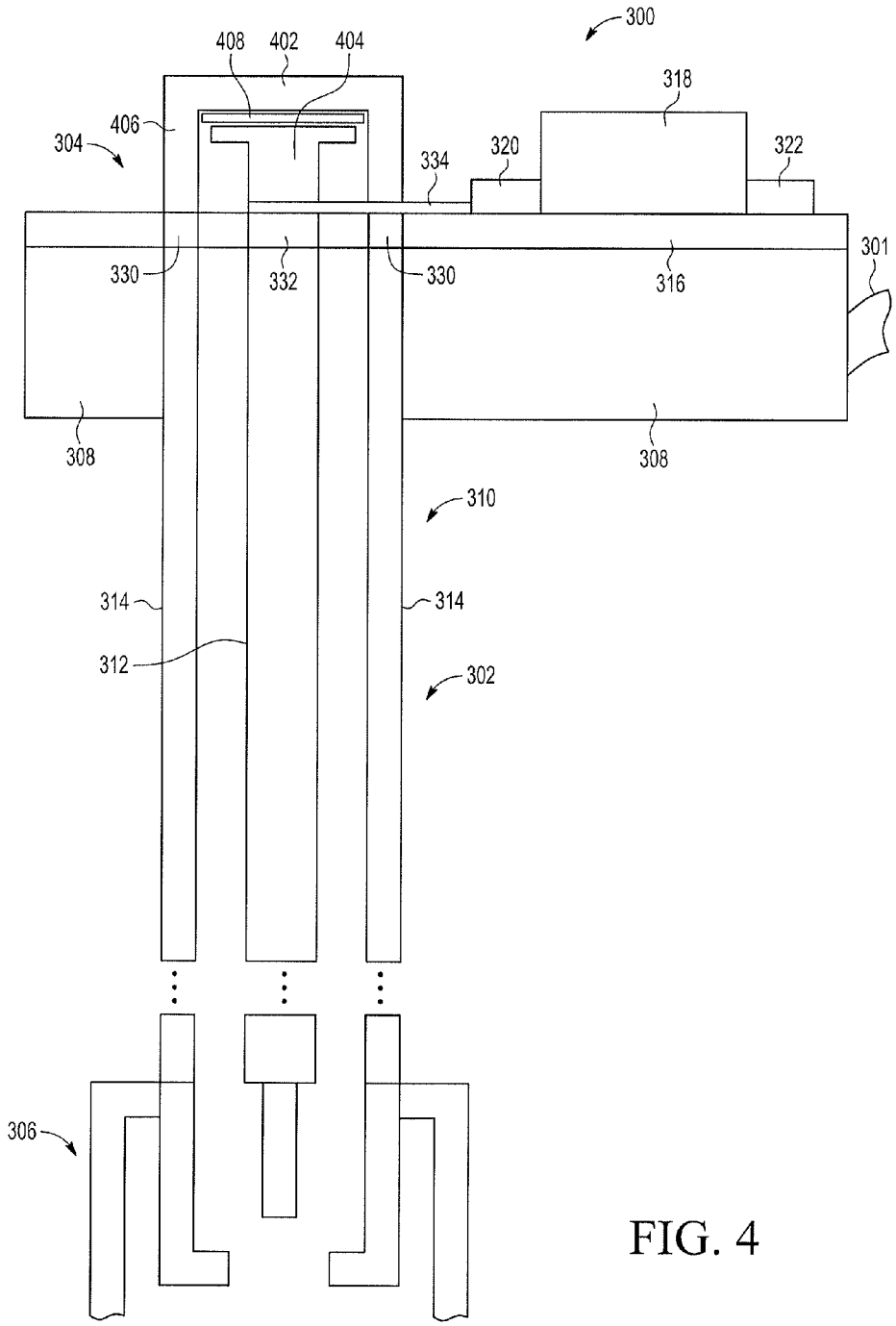
FIG. 4 shows the system of FIG. 3A including a modified cap to provide improved direct current (DC) isolation.

In some embodiments, to facilitate the application of a DC bias voltage to core conductor 312, the center post of cap 324 may be DC-isolated from the wall of cap 324. To illustrate, FIG. 4 shows system 300 of FIG. 3A including a modified cap 402 to provide improved DC isolation of core conductor 312.

As illustrated, system 300 includes a modified cap 402 structure. Cap 402 includes an outer wall 406. Outer wall 406 is constructed of a conductive material, such as aluminum or copper, and is electrically connected to shield 314 via THVs 330. Cap 402 also includes a center post 404, which is electrically connected to core conductor 312 via THV 332.

Center post 404 and outer wall 406 of cap 402 are not electrically coupled to one another. As illustrated, in FIG. 4, dielectric 408 is disposed between center post 404 and outer wall 406 to provide DC isolation between center post 404 and outer wall 406. Dielectric 408 may comprise any material suitable for inhibiting the flow of DC electricity between center post 404 and outer wall 406, such as glass, air, plastic, mineral oil, and the like.

With dielectric 408 disposed between center post 404 and outer wall 406, core conductor 312 is DC isolated and a desired DC voltage can be applied thereto. Additionally, because the sandwich structure containing outer wall 406, dielectric 408 and center post 404 forms a capacitor, the high frequency signals associated with the RF output signal of RF generator 318 pass through dielectric 408, enabling cap 402 in combination with core conductor 312 and shield 314 to operate as an antenna for the high frequency signals.

Figure 5A:
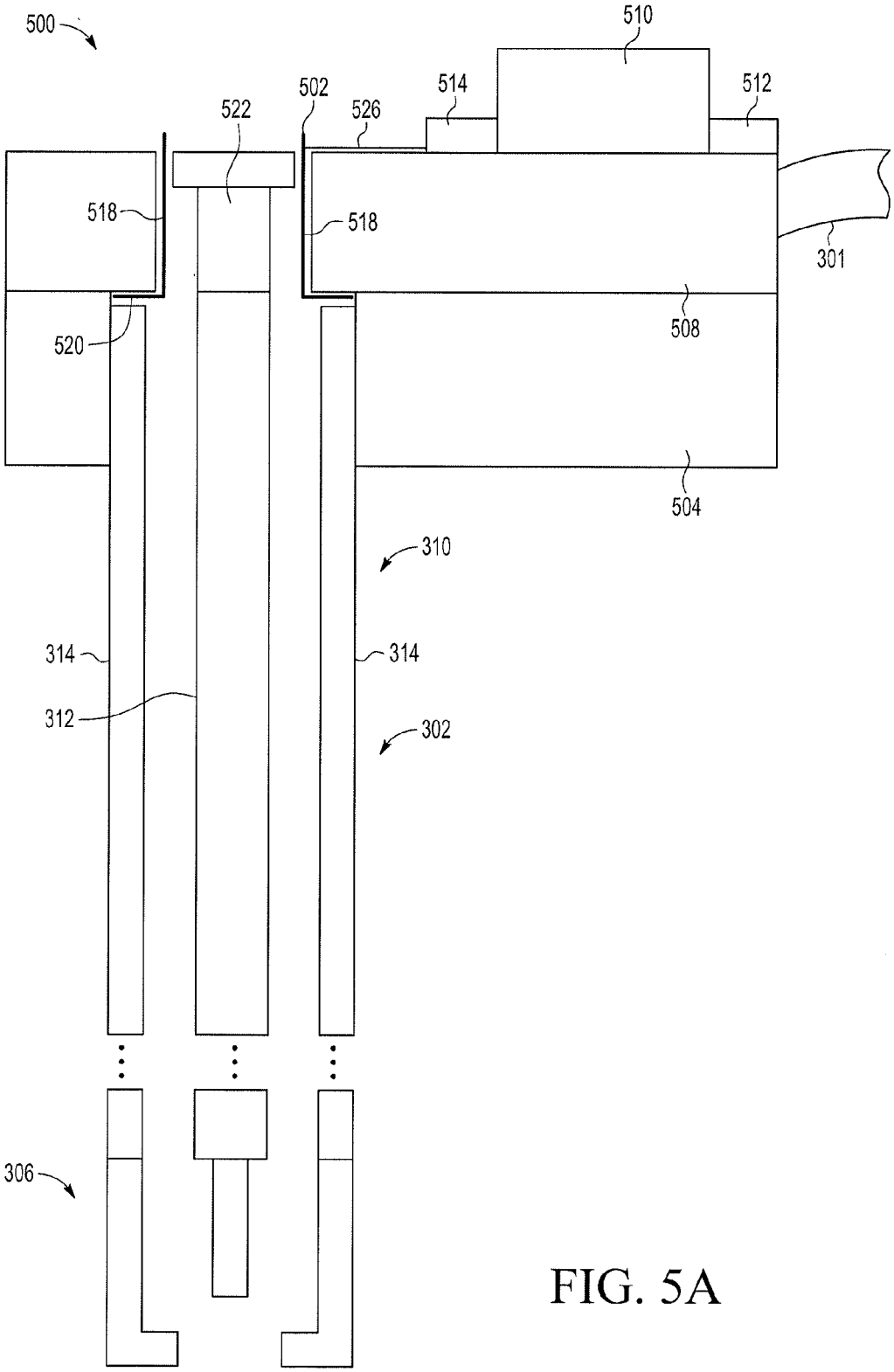
FIG. 5A shows a cross-sectional view of another embodiment of an RF power delivery system configured to connect an RF power distribution system to a radiation device.
Figure 5B:
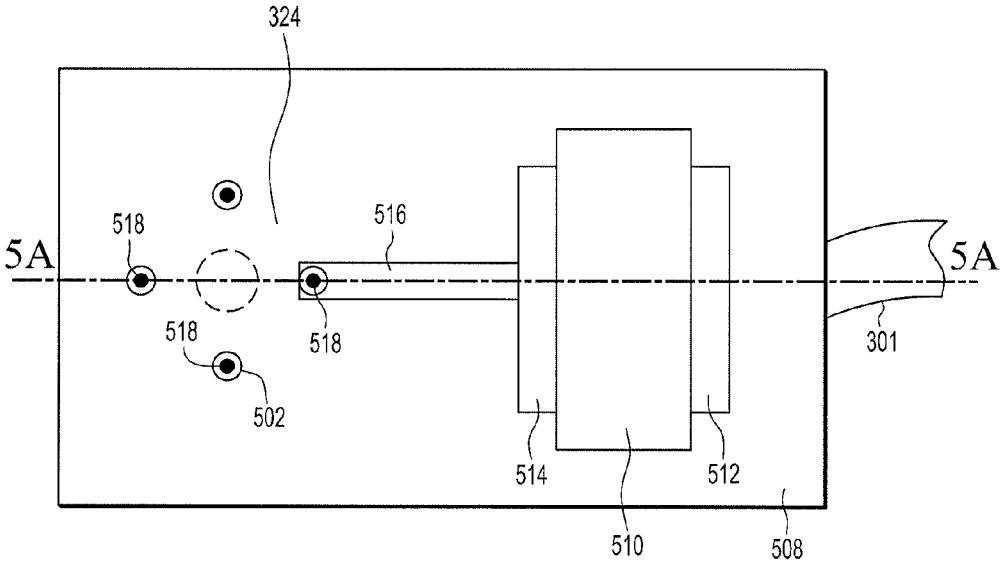
FIG. 5B shows a top view of the RF power delivery system of FIG. 5A.
Figure 5C:
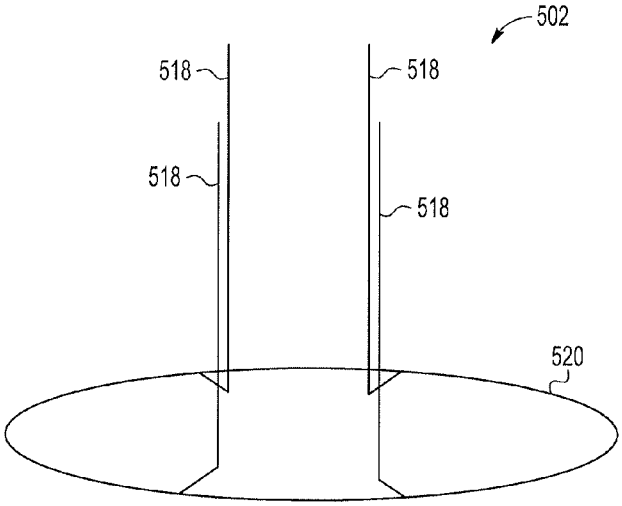
FIG. 5C shows a detailed view of an embodiment of the induction loop depicted in FIGS. 5A and 5B.

An alternative implementation of the plasma ignition coupling system is illustrated in FIGS. 5A-5C. FIG. 5A shows a cross-sectional view of an embodiment of an RF power delivery system 500 configured to connect an RF power distribution system to a spark plug or other radiation device taken along the line 5A of FIG. 5B. FIG. 5B shows a top view of plasma ignition system 500. FIG. 5C shows a detailed view of induction loop 502 of system 500.

As illustrated, system 500 includes a similar sleeve 302 having core conductor 312 and shield 314 as that illustrated in FIG. 3A. Additionally, sleeve 302 incorporates plug boot 306.

System 500 includes a housing 504, similar to the housing 308 of FIG. 3A. A substrate 508 is formed over housing 504. Substrate 508 includes any structure over which one or more electrical components can be mounted and interconnected. In various embodiments, substrate 508 may include a printed circuit board (PCB), flexible PCB, or any other substrate material or combination of materials. In other embodiments, housing 504 and substrate 508 may be combined so as to be formed out of a single structure.

RF generator 510, having input contact pad 512 and output contact pad 514, is mounted on substrate 508. Output contact pad 514 of RF generator 510 is connected to trace 526. RF generator 510 operates to generate an output RF signal at output contact pad 514 suitable for application to a spark plug or other radiation device for the generation of plasma energy. RF generator 510 may operate in a similar manner and provide similar functions to that of RF generator 318.

Inductive loop 502 is sandwiched between substrate 508 and shield 314 of sleeve 302. Inductive loop 502 includes a number of legs 518. During construction of system 500, legs 518 of inductive loop 502 are inserted through the bottom of holes formed in substrate 508. Legs 518 are sized so that, when legs 518 are fully inserted through substrate 508 so that ring 520 of inductive loop 502 contacts the undersurface of substrate 508, legs 518 penetrate through substrate 508. When fully inserted, as illustrated in FIG. 5A, legs 518 make electrical contact with trace 526 formed over substrate 508. Further detail of the configuration of legs 518 and ring 520 of inductive loop 502 can be seen in FIG. 5C. With inductive loop 502 inserted into substrate 508, shaft 310 of sleeve 302 is inserted through an opening in housing 504 to sandwich ring 520 of inductive loop 502 between shield 314 and substrate 508. Sleeve 302 may be coupled to housing 504 via a friction fit, adhesive, a threaded connection, or may simply reside in the opening formed in housing 504.

Although in the present embodiment inductive loop 502 is shown having four legs 518, it is to be understood that inductive loop 502 may have any number of legs 518, with a corresponding number of openings being formed within substrate 508. Inductive loop 502 may be formed using any suitable fabrication process. In one embodiment, inductive loop 502 may be a stamped article formed from a metal such as copper or aluminum. Alternatively, inductive loop 502 may be cast or machined.

As shown in FIG. 5A, substrate 508 includes post 522. Post 522 includes a conductive material, such as copper or aluminum. When shaft 310 of sleeve 302 is inserted through the opening in housing 504, post 522 makes electrical contact with core conductor 312.

During operation, output contact pad 514 of RF generator 510 is connected to one or more legs 518 of inductive loop 502 (e.g., via trace 526). The RF signal generated by RF generator 510 is then communicated through inductive loop 502 into shield 314 of sleeve 302 and, ultimately into a connected spark plug or radiation device.

In other embodiments, however, multiple RF generators may be mounted to substrate 508 and connected separately to one or more of legs 518 of inductive loop 502. In such a configuration, different RF signals can be supplied to the legs 518 of inductive loop 502 and into shield 314. The use of multiple RF generators to supply an RF input signal to each leg of inductive loop 502 may facilitate thermal management, increase total output power, overcome individual device power limitations, and/or add redundancy to the overall system.

Furthermore, core conductor 312 may be set to a desired DC voltage of sufficient magnitude to generate a spark in a connected spark plug or radiation device. As described above, this spark, although less effective than plasma at causing ignition, can be utilized to provide a seed spark to facilitate the formation of plasma, or as a back-up spark in the event that the plasma generation system fails. Core conductor 312 can be set to a particular DC voltage, for example, by providing post 522 with that desired DC voltage.

The size and shape of inductive loop 502 can be adjusted to provide impedance matching between the transmission line (e.g., shield 314 and core conductor 312) and the output impedance of RF generator 510. Parameters of inductive loop 502 that can be adjusted to provide impedance matching include the radius of ring 520 and the length of legs 518, the distance of ring 520 and legs 518 from the center conductor, the thickness and aspect ratio of legs 518 and ring 520, and any twist or angle in the legs 518 from top to bottom. The optimization of the design of inductive loop 502 may involve elements of electromagnetic simulation and experimentation.

Figure 6:
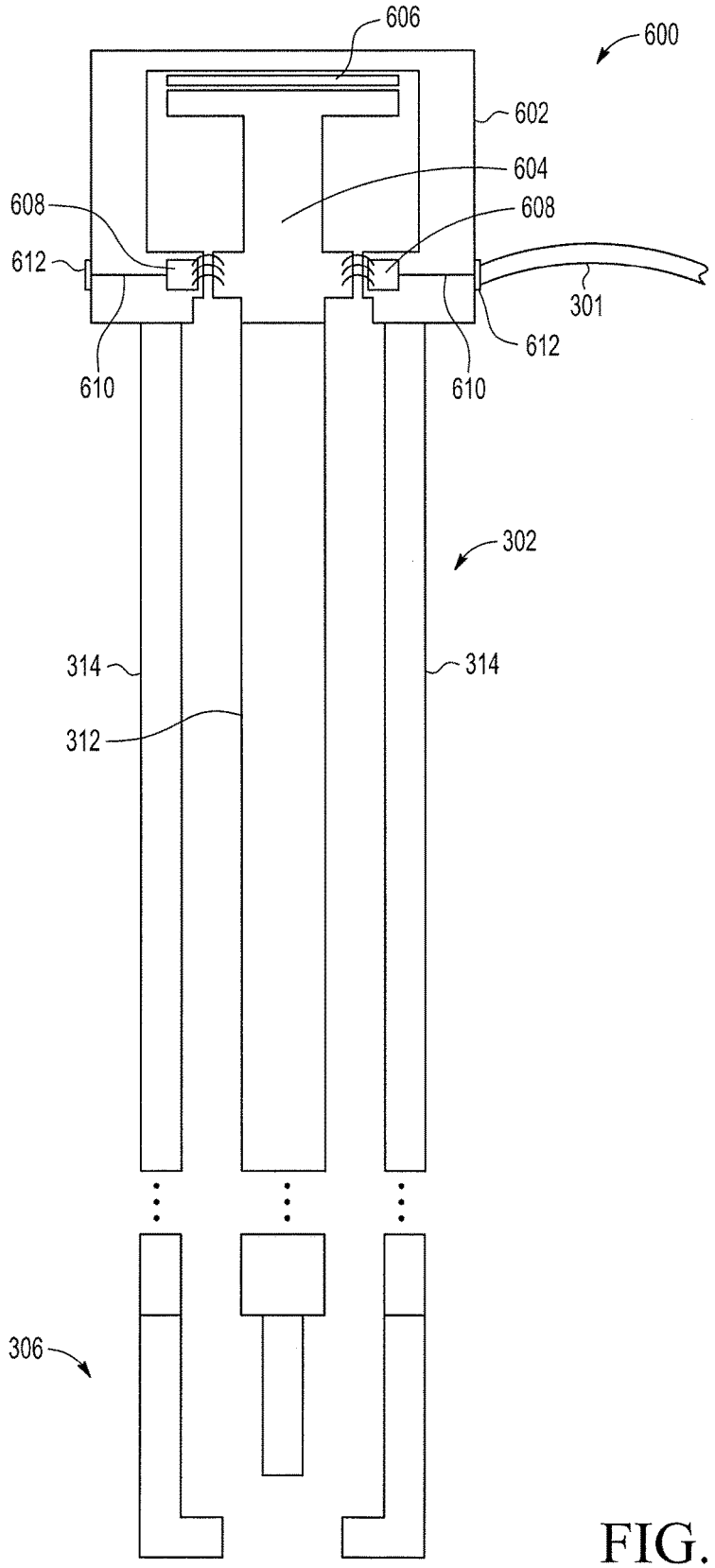
FIG. 6 shows a cross-sectional view of another embodiment of an RF power delivery system including an RF generator incorporated into a cap.

An alternative implementation of the plasma ignition coupling system is illustrated in FIG. 6. FIG. 6 shows a cross-sectional view of RF power delivery system 600. System 600 is configured to connect an RF power distribution system to a spark plug or other radiation device. As illustrated, system 600 includes a similar sleeve 302 having core conductor 312 and shield 314 as that illustrated in FIG. 3A. Additionally, sleeve 302 incorporates plug boot 306.

System 600 includes cap 602 mounted to sleeve 302. Cap 602 is fabricated from a conductive material, such as copper or aluminum. Cap 602 is connected to sleeve 302 forming an electrical connection between cap 602 and shield 314. Post 604 is positioned within cap 602. In the embodiment shown in FIG. 6, dielectric 606 is disposed between post 604 and cap 602. Dielectric 606 includes any material suitable for inhibiting the flow of DC electricity between post 604 and cap 602. This allows post 604 and core conductor 312 to be set to a desired DC voltage of sufficient magnitude to generate a spark in a connected spark plug or radiation device. As described above, this spark, although less effective than plasma at causing ignition, can be utilized to provide a seed spark to facilitate the formation of plasma, or as a back-up spark in the event that the plasma generation system fails.

In other embodiments, however, where dielectric 606 is not utilized, cap 602 and post 604 may be fabricated from a single piece of material, so that post 604 is part of cap 602.

One or more RF generators 608 are mounted within cap 602. RF generators 608 may be mounted directly to cap 602, as is shown in FIG. 6. Or, alternatively, RF generators 608 may be mounted on post 604. RF generators 608 operate to generate an output RF signal suitable for application to a spark plug or other radiation device for the generation of plasma energy. RF generators 608 may operate in a similar manner and provide similar functions to that of RF generator 318, described above.

RF generators 608 are connected to center post 604 via a plurality of wire bonds, although any mechanism to communicating the output RF signal of RF generators 608 into center post 604 may be utilized. For example, a physical connection between RF generators 608 and center post 604 may be formed by a wire, wirebond, or other conductive structure. Alternatively, the output signal of RF generators 608 may be communicated into center post 604 via inductive or capacitive coupling techniques. The location along center post 604 at which the output signal of RF generators 608 is injected will determine the impedance observed by RF generators 608. As such, by selecting an appropriate location, the impedance observed by RF generators 608 can be selected to match the output impedance of RF generators 608.

RF generators 608 are connected by conductors 610 to contact pads 612. Contact pads 612 are formed on an external surface of cap 602. Input cable 301 is coupled to one or more of contact pads 612. An input signal received via input cable 301 is communicated to RF generators 608 that, in turn, communicate an RF signal into center post 604, core conductor 312 and, ultimately, a spark plug or other radiation device coupled to plug boot 306.

Depending upon the type of input signal received via input cable 301 (e.g., a control signal, an RF signal, or an amplified RF signal), RF generators 608 may implement one or more of the functions provided by control unit 130, RF signal generator 112, and pre-amplifier 114 of FIG. 1.

Although FIG. 1 illustrates and corresponds to a four cylinder engine and a plasma ignition system configured to produce a plasma discharge in each of four cylinders during a power stroke of a four stroke cycle, it should be understood that the various embodiments may be modified to apply to engines that have more or fewer than four cylinders, and also to engines that have an odd number of cylinders. More particularly, embodiments may be generalized to apply to engines that have N cylinders, where N is any reasonable integer.

In addition, it should be understood that the various embodiments may be used in both two-stroke engines and four-stroke engines. Further, although the various embodiments may be implemented in motor vehicles, the embodiments also may be implemented in other fuel powered systems, including generators, landscaping equipment (e.g., lawnmowers, weed trimmers, blowers), heavy equipment (e.g., tractors, cranes, and so on), trains, aircraft, and watercraft, to name a few additional examples. In addition, the various embodiments may be implemented in other types of systems in which distributed, high power RF signals are desired. For example, embodiments may be implemented in multiple antenna communication systems (e.g., multiple-input and/or multiple-output (MIMO) systems and/or broadcast systems), and/or in microwave ovens with multiple radiation elements that produce RF energy for the purpose of heating objects, to name just two examples.

An embodiment of a device includes a substrate, and a radio frequency generator on the substrate. The radio frequency generator is configured to receive an input signal and output a radio frequency signal at an output contact pad. The device includes a coaxial conductor coupled to a first surface of the substrate. The coaxial conductor includes a conductive core and a conductive shield around the conductive core and is configured to transmit the radio frequency signal to a radiation device. The device includes a cap coupled to the substrate and extending from a second surface of the substrate opposite the first surface. The cap includes an outer wall and a center post. The outer wall is electrically connected to the conductive shield of the coaxial conductor and the center post is electrically connected to the conductive core of the coaxial conductor. The output contact pad is electrically connected to the conductive core.

An embodiment of a device includes a coaxial conductor including a conductive core and a conductive shield around the conductive core. The coaxial conductor includes a first end and a second end. The device includes a cap coupled to the first end of the coaxial conductor. The cap includes an outer wall and a center post. The outer wall is electrically connected to the conductive shield of the coaxial conductor and the center post is electrically connected to the conductive core of the coaxial conductor. The device includes a radio frequency generator electrically connected to the center post, and a plug boot coupled to the second end of the coaxial conductor. The plug boot is configured to couple to a radiation device.

An embodiment of a method includes providing a substrate including a coaxial conductor coupled to a first surface of the substrate and a cap coupled to the substrate. The cap extends from a second surface of the substrate opposite the first surface. The cap includes an outer wall and a center post. The outer wall is electrically connected to a conductive shield of the coaxial conductor and the center post being electrically connected to a conductive core of the coaxial conductor. The method includes supplying a radio frequency signal to at least one of the center post of the cap and the conductive core of the coaxial conductor.

An embodiment of a method includes providing a substrate, and coupling a radio frequency generator to the substrate. The radio frequency generator is configured to receive an input signal and output a radio frequency signal at an output contact pad. The method includes coupling a coaxial conductor to a first surface of the substrate. The coaxial conductor includes a conductive core and a conductive shield around the conductive core and is configured to transmit the radio frequency signal to a radiation device. The method includes coupling a cap to the substrate. The cap extends from a second surface of the substrate opposite the first surface. The cap includes an outer wall and a center post. The outer wall is electrically connected to the conductive shield of the coaxial conductor and the center post is electrically connected to the conductive core of the coaxial conductor. The output contact pad is electrically connected to the conductive core.

The terms "first," "second," "third," "fourth" and the like in the description and the claims are used for distinguishing between elements and not necessarily for describing a particular structural, sequential or chronological order. It is to be understood that the terms so used are interchangeable under appropriate circumstances. Furthermore, the terms "comprise," "include," "have" and any variations thereof, are intended to cover non-exclusive inclusions, such that a circuit, process, method, article, or apparatus that comprises a list of elements is not necessarily limited to those elements, but may include other elements not expressly listed or inherent to such circuit, process, method, article, or apparatus. The term "coupled," as used herein, is defined as directly or indirectly connected in an electrical or non-electrical manner.

While the principles of the inventive subject matter have been described above in connection with specific systems, apparatus, and methods, it is to be clearly understood that this description is made only by way of example and not as a limitation on the scope of the inventive subject matter. The various functions or processing blocks discussed herein and illustrated in the Figures may be implemented in hardware, firmware, software or any combination thereof. Further, the phraseology or terminology employed herein is for the purpose of description and not of limitation.

The foregoing description of specific embodiments reveals the general nature of the inventive subject matter sufficiently that others can, by applying current knowledge, readily modify and/or adapt it for various applications without departing from the general concept. Therefore, such adaptations and modifications are within the meaning and range of equivalents of the disclosed embodiments. The inventive subject matter embraces all such alternatives, modifications, equivalents, and variations as fall within the spirit and broad scope of the appended claims.

What is claimed is:

1. A device, comprising:

a substrate;

a radio frequency generator on the substrate, the radio frequency generator being configured to receive an input signal and output a radio frequency signal at an output contact pad;

a coaxial conductor coupled to a first surface of the substrate, the coaxial conductor including a conductive core and a conductive shield around the conductive core and being configured to transmit the radio frequency signal to a radiation device; and a cap coupled to the substrate and extending from a second surface of the substrate opposite the first surface, the cap including an outer wall and a center post, the outer wall being electrically connected to the conductive shield of the coaxial conductor and the center post being electrically connected to the conductive core of the coaxial conductor; and wherein the output contact pad is electrically connected to the conductive core.

2. The device of claim 1, wherein the radio frequency generator and the substrate are formed in a single package.

3. The device of claim 1, wherein the coaxial conductor includes a plug boot configured to couple to the radiation device.

4. The device of claim 1, wherein the center post of the cap is direct current-isolated from the outer wall of the cap.

5. The device of claim 4, including a dielectric material disposed between the center post and the outer wall.

6. The device of claim 1, wherein a length of the center post and a length of the coaxial conductor are selected to achieve a desired input impedance observed by the radio frequency generator.

7. The device of claim 1, wherein at least one of a geometry of the cap and a geometry of the coaxial conductor are selected to achieve a desired input impedance observed by the radio frequency generator.

8. The device of claim 1, wherein the at least one of the conductive core and the conductive shield of the coaxial conductor have a non-circular cross section.

9. The device of claim 1, wherein the conductive core of the coaxial conductor includes a conductive material formed on a substrate.

10. A device, comprising:

a coaxial conductor including a conductive core and a conductive shield around the conductive core, the coaxial conductor including a first end and a second end;

a cap coupled to the first end of the coaxial conductor, the cap including an outer wall and a center post, the outer wall being electrically connected to the conductive shield of the coaxial conductor and the center post being electrically connected to the conductive core of the coaxial conductor;

a radio frequency generator electrically connected to the center post; and a plug boot coupled to the second end of the coaxial conductor, the plug boot being configured to couple to a radiation device.

11. The device of claim 10, wherein the radio frequency generator is mounted to the cap.

12. The device of claim 10, wherein the radio frequency generator is electrically connected to the center post by at least one of an inductive coupling and a capacitive coupling.

13. The device of claim 10, wherein the center post of the cap is direct current-isolated from the outer wall of the cap.

14. The device of claim 13, including a dielectric material disposed between the center post and the outer wall.

15. The device of claim 10, wherein a location along the center post at which the radio frequency generator is electrically connected to the center post is selected to achieve a desired input impedance observed by the radio frequency generator.

16. The device of claim 10, wherein at least one of a geometry of the cap and a geometry of the coaxial conductor are selected to achieve a desired input impedance observed by the radio frequency generator.

17. The device of claim 10, wherein the at least one of the conductive core and the conductive shield of the coaxial conductor have a non-circular cross section.

18. The device of claim 10, wherein the conductive core of the coaxial conductor includes a conductive material formed on a substrate.

19. A method, comprising:

providing a substrate including a coaxial conductor coupled to a first surface of the substrate and a cap coupled to the substrate, the cap extending from a second surface of the substrate opposite the first surface, the cap including an outer wall and a center post, the outer wall being electrically connected to a conductive shield of the coaxial conductor and the center post being electrically connected to a conductive core of the coaxial conductor; and supplying a radio frequency signal to at least one of the center post of the cap and the conductive core of the coaxial conductor.

20. The method of claim 19, including connecting the coaxial conductor to a radiation device before supplying the radio frequency signal.

* * * * *